United States Patent [19]

Yanagishima et al.

[11] 4,363,471

[45] Dec. 14, 1982

[54] STEEL STRIP CONTINUOUS ANNEALING APPARATUS

[75] Inventors: Fumiya Yanagishima; Yuji Shimoyama; Hideo Sunami; Yukio Ida; Goji Katsushima; Munetoshi Suzuki; Takeo Ohnishi, all of Chiba, Japan

[73] Assignee: Kawasaki Steel Corporation, Hyogo, Japan

[21] Appl. No.: 199,199

[22] Filed: Oct. 21, 1980

[30] Foreign Application Priority Data

Oct. 31, 1979 [JP] Japan ..... 54-141505

[51] Int. Cl.[3] ..... C21D 9/56

[52] U.S. Cl. ..... 266/111; 266/103; 266/252; 266/259

[58] Field of Search ..... 266/274, 249, 251, 252, 266/259, 78, 102, 103, 111; 226/104, 107, 118, 119; 432/59, 60; 242/75.3

[56] References Cited

U.S. PATENT DOCUMENTS

| | | | |
|---|---|---|---|
| 3,060,945 | 10/1962 | Spenle | 226/118 |
| 3,269,714 | 8/1966 | McKie | 266/102 |
| 3,381,868 | 5/1968 | Vogeler | 226/118 |
| 3,752,459 | 8/1973 | Kawazoko et al. | 266/111 |
| 3,805,571 | 4/1974 | Toda et al. | 266/111 |
| 3,877,684 | 4/1975 | Kurihara et al. | 266/111 |
| 4,012,028 | 3/1977 | Izraileuich et al. | 266/103 |
| 4,060,186 | 11/1977 | Nabhan | 226/118 |

OTHER PUBLICATIONS

Araki et al., "Development of Continuously Annealed High Strength Cold Rolled Sheet Steels", *Transactions ISIJ,* vol. 17, 1977, pp. 701–709.

Toda et al., "Metallurgical Investigations on Continuous Annealing of Low-carbon Capped-Steel Sheets", *Transactions ISIJ,* vol. 15, 1975, pp. 305–313.

Kubotera et al., "Development of a Continuous Annealing Process for the Drawing Quality Steel Strip", *Transactions ISIJ,* vol. 17, 1977, pp. 663–670.

Toda et al., "Production of drawing-quality steel sheet by continuous annealing and processing",*Sheet Metal Industries,* Sep. 1974, pp. 586–593.

Masumoto, "No. 2 Continuous Annealing Line for Drawing Quality Cold Strip at Nippon Kokan, Fukuyama Works", *Steel Times* Jan. 1977, pp. 63–68.

Toda et al., "World's first continuous annealing and processing line for cold rolled strip", *Iron and Steel Engineer,* Oct. 1973, pp. 21–24.

Toda et al., "Production of drawing-quality steel sheet by continuous annealing and processing", Sheet Metal Industries, Sep. 1974, pp. 25–29 *Automotive Industries,* Sep. 1, 1974, pp. 30–31.

Coughhanour et al., Process Systems Analysis and Control McGraw-Hill Book Co. 1965 pp. 102–104.

*Primary Examiner*—John P. Sheehan

*Attorney, Agent, or Firm*—Koda and Androlia

[57] ABSTRACT

A steel strip continuous annealing apparatus comprising: a steel strip feeder; a heating-soaking zone for heating and soaking a steel strip at a predetermined temperature; a first cooling zone for rapidly cooling the steel strip at a predetermined cooling rate; a second cooling zone for slowly cooling the steel strip or holding same at a predetermined temperature; a third cooling zone for cooling the steel strip to substantially room temperature; and a steel strip carryout device; wherein the first cooling zone incorporates therein forcible cooling means, the second cooling zone incorporates therein hot-cold change-over means and the third cooling zone incorporates therein forcible cooling means, while said steel strip continuous annealing apparatus further comprises: means for directly bypassing the steel strip from the heating-soaking zone through a first bypass passageway to the second cooling zone; and means for directly bypassing the steel strip from the first cooling zone through a second bypass passageway to the steel strip carry-out device; so that the steel strips different in dimensions and required heat cycle can be efficiently annealed.

9 Claims, 17 Drawing Figures

STEEL STRIP CONTINUOUS ANNEALING APPARATUS

BACKGROUND OF THE INVENTION

1. Field of the Invention

The present invention relates to steel strip continuous annealing apparatuses, and more particularly to a steel strip continuous annealing apparatus comprising a heating zone, a soaking zone and cooling zones.

2. Description of the Prior Art

Recently, annealing processes for rendering predetermined processability, deep drawing properties and the like to cold-rolled steel strips have been carried out by continuous annealing apparatuses. These continuous annealing apparatuses are formed into peculiar predetermined configurations depending upon grades of steel, thickness of sheet, temperatures for heating and soaking, cooling conditions and the like.

More specifically, a continuous annealing apparatus for producing black tinplates, for example, has such a function that, in which, a steel strip having a sheet thickness of 0.15 to 0.6 mm and a sheet width of 600 to 1000 mm is soaked at a temperature of 700° to 800° C., thereafter, slowly cooled to about 450° C. from the temperature described above, and further, rapidly cooled to 100° C. to substantially room temperature, where the steel strip is not oxidized, outside the furnace, and consequently, the continuous annealing apparatus comprises a heating, a soaking and a slowly cooling and a rapidly cooling zones. In contrast thereto, a continuous annealing apparatus for producing cold-rolled steel sheets for drawing has such a function that, in which, a steel strip for producing cold-rolled steel sheet for drawing having a sheet thickness of 0.4 to 1.6 mm and a sheet width of 800 to 1500 mm or a steel strip for producing a soft black tinplate having a sheet thickness of 0.15 to 0.6 mm and a sheet width of 600 to 1000 mm is soaked to a temperature of 700° to 850° C., thereafter, rapidly cooled to a temperature of 300° to 500° C. at a cooling rate of approximately 10° to 100° C./sec, subjected to an overaging treatment being held at the temperature of 300° to 500° C. for 1 to 5 min so as to be satisfactorily softened, and then, rapidly cooled, and consequently, the continuous annealing apparatus comprises a heating, a soaking, a rapidly cooling, overaging and a final cooling zones. Furthermore, a continuous annealing apparatus for producing high-strength cold-rolled steel sheet having a mixed structure has such a function that, in which, a steel strip having a sheet thickness and a sheet width similar to those of the cold-rolled steel sheet for drawing as described above is heated to a temperature of 800° to 850° C., caused to partially generate $\gamma$ phase in a ferrite structure, rapidly cooled at a cooling rate of approximately 10° to 100° C./sec, and turned into a product as it is. Further, a continuous annealing apparatus for producing silicon steel sheets has such a function that, in which, a steel sheet having a sheet thickness of 0.3 to 0.7 mm and a sheet width of 600 to 1000 mm can be heated to a comparatively high temperature of 800° to 1000° C. and soaked, and thereafter, cooled, and consequently, comprises a heating zone, a soaking zone and a cooling zone. As has been described hereinabove, each continuous annealing apparatus is required to have a peculiar heat cycle depending on the material quality of the steel sheet to be annealed and a peculiar configuration depending on the dimensions of the steel sheet, and, it is difficult to treat in one and the same continuous annealing apparatus the black tinplates, cold-rolled steel sheet for drawing, soft black tinplates, high-strength cold-rolled steel sheets, silicon steel sheets or the like, which are different in heat cycle and dimensions.

However, it is uneconomical to set the rate of conveying the steel strip at an excessively small value in a continuous annealing apparatus because the continuous annealing apparatuses each have a production capacity of 20,000 to 40,000 t/mon on the average. Consequently, it is apparently inadvisable for an enterprise having an amount of customers demand insufficient to constantly and sufficiently operate the respective types of continuous annealing apparatuses to possess the abovedescribed continuous annealing apparatuses meeting the conditions required for the types of steel strips. From the viewpoint as described above, necessity has been voiced for making it possible to selectively treat the black tinplates, cold-rolled steel sheets, high-strength cold-rolled steel sheets or silicon steel sheets in a single continuous annealing apparatus.

Furthermore, the continuous annealing apparatus forms a considerably long continuous line, and therefore, in order to maintain a stabilized operating condition in the furnace, it is necessary to render proper tensions to the steel strip in the furnace. For example, in the rapidly cooling zone where the steel strip is rapidly cooled from the soaked condition, cooling irregularities tend to occur in the steel strip because the steel strip is cooled at a high cooling rate, if the tension are expensively high, then irregular shapes of the steel strip and cooling buckling and the like tend to occur, and consequently, the tension of the steel strip in the rapidly cooling zone is required to be set at the level lower than other zones.

However, in the conventional continuous annealing apparatus, the tension acting on the steel strip in the furnace is regulated to be substantially uniform, and hence, the tension of the steel strip only in the rapidly cooling zone cannot be set at a discontinuously low value.

More specifically, in the conventional continuous annealing apparatus, the conditions of tension in the respective zones of the furnace cannot be controlled independently of one another, thus, presenting the problems including the ruptures in the steel strip due to the movement of the steel strip in a zigzag fashion, damages caused to the furnace, fluctuations in width of the steel strip, irregular shapes of the steel strip, local fluctuations in shapes of the steel strip and the like.

SUMMARY OF THE INVENTION

The present invention has been developed to obviate the abovedescribed disadvantages of the prior art and has as its object the provision of a steel strip continuous annealing apparatus wherein, particularly, steel strips different in dimensions and required heat cycles from one another can be efficiently and stably annealed.

To achieve the abovedescribed object, according to the present invention, firstly, a steel strip continuous annealing apparatus comprising: a steel strip feeder; a heating-soaking zone for heating and soaking the steel strip at a predetermined temperature; a first cooling zone for rapidly cooling the steel strip at a predetermined cooling rate; a second cooling zone for slowly cooling the steel strip or holding same at a predetermined temperature; a third cooling zone for cooling the steel strip to substantially room temperature; and a steel strip carry-out device; is of such an arrangement that the first cooling zone incorporates therein forcible cooling means, the second cooling zone incorporates therein hot-cold change-over means, the third cooling zone incorporates therein forcible cooling means and further comprises means for directly bypassing the steel strip from the heating zone through a first bypass passageway to the second cooling zone and means for directly bypassing the steel strip from the first cooling zone through a second bypass passageway to a steel strip carry-out device.

In the present invention, secondly, heat isolating means is provided at a boundary portion between the first cooling zone and the first bypass passageway of the steel strip continuous annealing apparatus according to the first inventive conception as described above.

In the present invention, thirdly, tension control means is incorporated in the first cooling zone of the steel strip continuous annealing apparatus according to the second inventive conception as described above.

BRIEF DESCRIPTION OF THE DRAWINGS

The abovementioned features and object of the invention will become more apparent with reference to the following description, taken in conjunction with the accompanying drawings, wherein like reference numerals denote like elements, and in which.

DETAILED DESCRIPTION OF THE INVENTION

Description will hereunder be given of one embodiment of the present invention with reference to the drawings.

Figure 1:
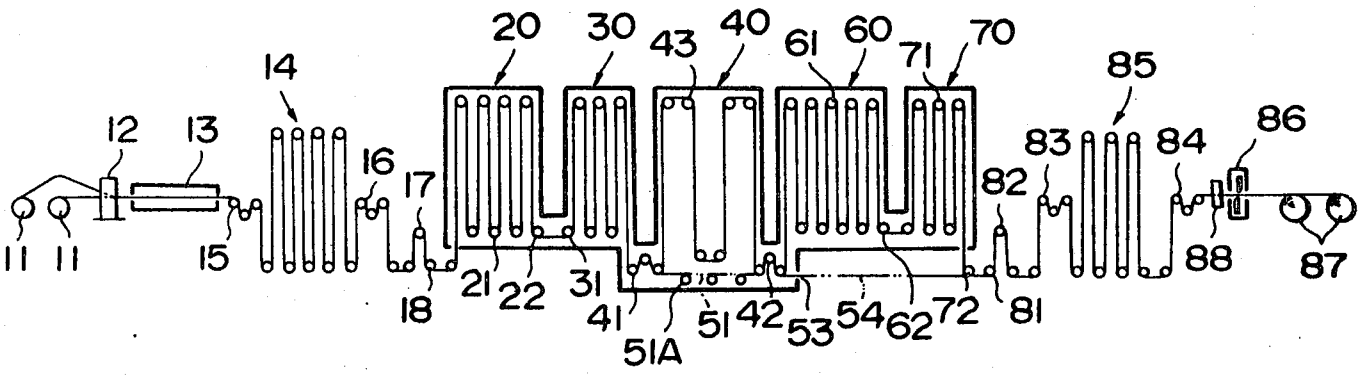
FIG. 1 is a general arrangement view showing one embodiment of the steel strip continuous annealing apparatus according to the present invention.

FIG. 1 is an explanatory view showing the general arrangement of one embodiment of the steel strip continuous annealing apparatus according to the present invention. A steel strip feeder is provided at the inlet side of this continuous annealing apparatus as will be described below. Namely, a steel strip, which has been cold-rolled, is wound out of an uncoiler 11, connected to another steel strip in a welder 12, and rolling oil adhered to the surface of the steel strip is removed therefrom by a cleaning equipment 13. An inlet looper 14 is provided as a steel strip pool, so that connecting of a steel strip to another can be effected at the welder 12 without stopping the operation in the heating zone, and bridle rolls 15, 16 for isolating the tension of the steel strip are provided in front and rear of the inlet looper 14.

A dancer roll 17 and a tension meter roll 18, both of which constitute tension control means as will be described hereinafter, are provided between the bridle roll 16 and the inlet of the main body of furnace. A tension meter is incorporated in the tension meter roll 18 for detecting the actual tension of the steel strip, and the dancer roll 17 can control the tension of the steel strip by moving vertically due to the movement of the tension control means as will be described hereunder. In order to make it possible to continuously anneal the steel strips of every grades of steel, the main body of continuous annealing furnace comprises a heating zone 20, a soaking zone 30, a first cooling zone 40, a second cooling zone 60 and a third cooling zone 70, all of which will be described in detail hereunder, respectively.

Hearth rolls 21 for supporting the steel strip at the top and at the bottom and conveying same are provided in the heating zone 20 which further incorporates therein heating means for elevating the temperature of the steel strip to a predetermined temperature. The steel strip, which has been elevated in temperature to the predetermined temperature in the heating zone 20, passes across deflector rolls 22 provided at the outlet of the heating zone 20, and is delivered to the soaking zone 30.

Hearth rolls 31 for supporting the steel strip at the top and at the bottom and conveying same are provided in the soaking zone 30 incorporating therein soaking means for soaking the steel strip, which has been elevated in temperature in the heating zone 20 to a predetermined temperature. The steel strip, which has been soaked at a predetermined temperature in the soaking zone 30, passes across bridle rolls 41 provided at the outlet of the soaking zone 30, and is delivered to the first cooling zone 40.

Bridle rolls 41, 42 for isolating the tension of the steel strip in the first cooling zone 40 from the tension of the steel strip forwardly and rearwardly thereof are provided at the inlet and outlet of the first cooling zone 40 which incorporates therein hearth rolls 43 for supporting the steel strip at the top and at the bottom and conveying same.

Figure 2:
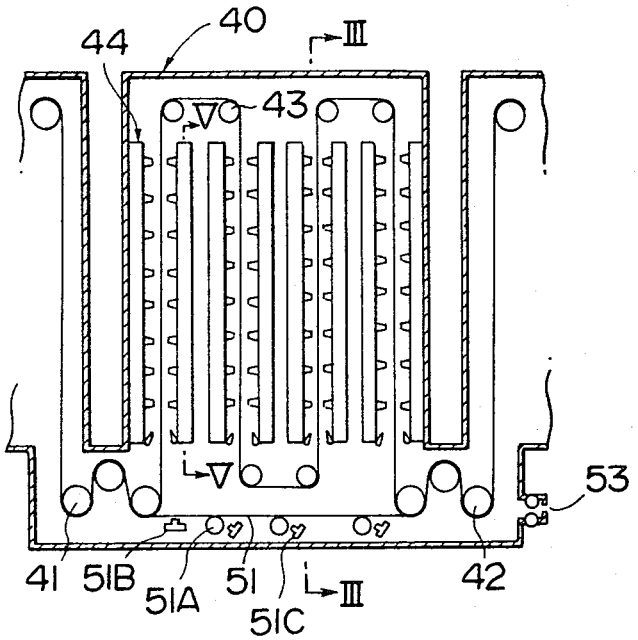
FIG. 2 is a sectional view showing the interior of the first cooling zone.
Figure 3:
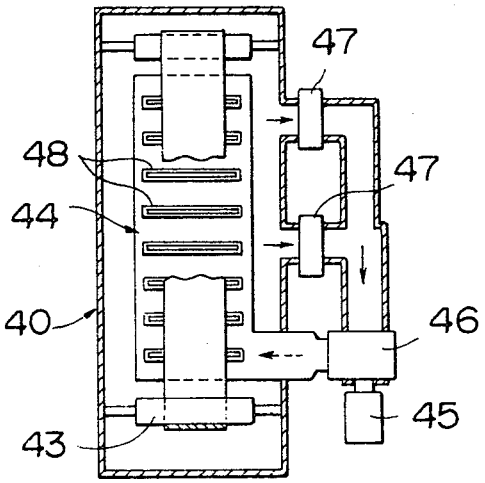
FIG. 3 is a sectional view taken along the line III—III in FIG. 2.
Figure 4:
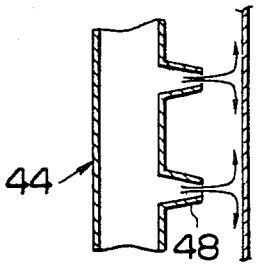
FIG. 4 is a sectional view enlargedly showing the essential portions in FIG. 2.

As shown in FIGS. 2 and 3, in this first cooling zone 40, plenum chambers 44 constituting forcible cooling means being opposed to the opposite surfaces of the steel strip being conveyed in the respective conveying passageways are provided at opposite sides of the respective conveying passageways through which the steel strip is vertically conveyed. HN gas as the gaseous atmosphere in the furnace is delivered into the plenum chambers 44 in a state of cooling gas through a water-cooled cooler 47 by the driving force of a circulating fan 46 driven by a motor 45, and the cooling gas, which has been delivered into the plenum chambers 44 in the compressed condition, is adapted to be blown out of slit-shaped blow-out nozzles 48 formed in the surfaces opposed to the steel strip toward the surface of the steel strip as shown in FIG. 4 so that the cooling gas can rapidly cool the steel strip at a predetermined cooling rate.

Figure 5:
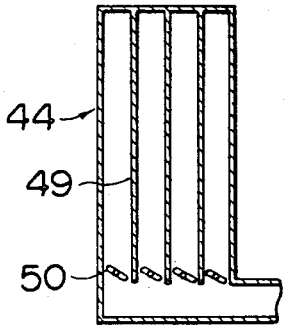
FIG. 5 is a sectional view taken along the line V—V in FIG. 2.

Further, as shown in FIG. 5, the interior of each plenum chamber 44 is divided in the widthwise direction by a plurality of partition walls 49, and, in flow-in portions of the respective compartments at the side of the circulating fan 46, there are provided flow rate regulating dampers 50, which are adjustable in opening degree independently of one another. More specifically, in each plenum chamber 44, the respective flow rate regulating dampers 50 are suitably regulated, whereby the distribution of flow rates of the cooling gas blown out of the blowout nozzles 48 in the widthwise direction is controlled, so that the steel strip can be uniformly rapidly cooled in the widthwise direction thereof.

Figure 6:
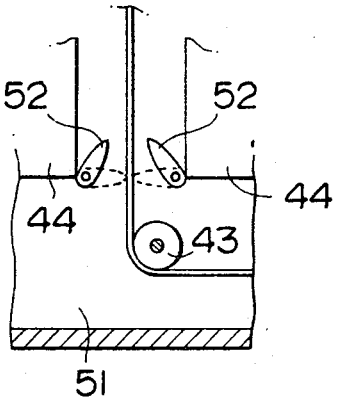
FIG. 6 is a sectional view showing the essential portions other than the abovedescribed ones in FIG. 4.

Furthermore, provided at the lower portion of the first cooling zone 40 is a first bypass passageway 51 for directly passing the steel strip from the bridle roll 41 to the bridle roll 42, so that the steel strip, which has been fed from the soaking zone 30, can be bypassed directly to the second cooling zone 60 without passing through conveying passageways in the first cooling zone 40 where the plenum chambers 44 are provided. Furthermore, provided at the lower ends of the plenum chambers 44 being opposed to the first bypass passageway 51 in the first cooling zone 40 are heat isolating dampers 52 being rotatable between a condition indicated by solid lines and a condition indicated by broken lines in FIG. 6, so as to form a passing region for allowing the steel strip to pass therethrough when the steel strip is conveyed through the first cooling zone 40 for being rapidly cooled and to divide the first bypass passageway 51 from the interior of the first cooling zone 40 when the steel strip passes through the first bypass passageway 51, so that the bad influence of the radiant heat emitted from the steel strip at high temperature passing through the first bypass passageway 51 to the plenum chambers 44 can be prevented.

Further, helper rolls 51A for supporting the steel strip and conveying same is provided in the first bypass passageway 51, and a strip thermometer 51B for detecting the temperature of the steel strip and a roll thermometer 51C for detecting the temperatures of the helper rolls 51A, respectively. More specifically, the roll temperatures of the helper rolls 51A are controlled in such a manner that the roll temperatures come close to the temperatures of the steel strip at respective positions of rolls predictably calculated by a method of controlling the roll temperature which will be described hereunder.

Figure 7:
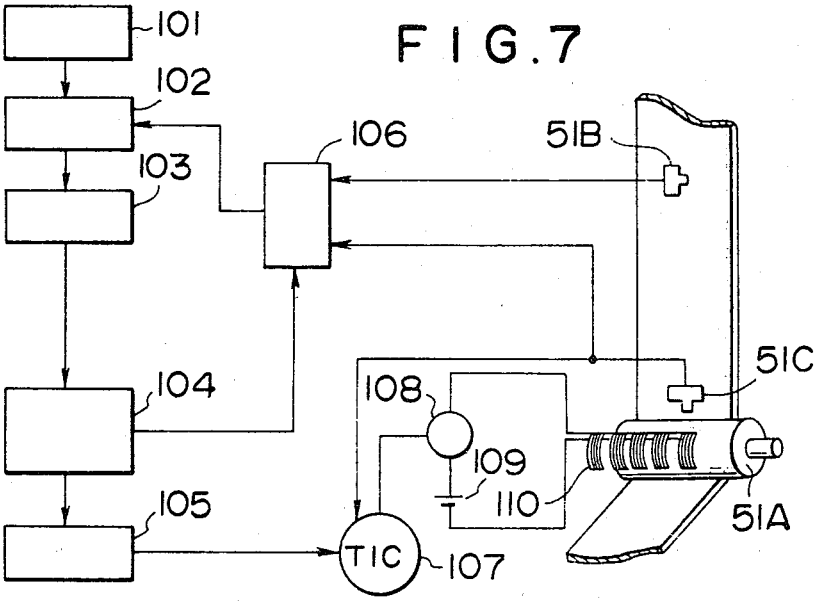
FIG. 7 is a circuit diagram showing method of controlling the temperatures of rolls.

Description will hereunder be given of the method of controlling the roll temperature of the abovedescribed helper rolls 51A with reference to FIG. 7. An annealing specification generator 101 is adapted to feed the annealing specification including the dimensions of the steel strip, heat pattern and the like to processor 102. This processor 102 calculates the maximum line speeds of the steel strip in the heating zone 20, soaking zone 30, the second cooling zone 60 and the third cooling zone 70 based on the annealing specification, and feeds the maximum line speeds for the respective zones to a common speed selector 103.

This common speed selector 103 selects the lowest speed out of the highest line speeds of the respective zones as the common speed in the continuous annealing furnace and feeds same to a steel strip temperature calculator 104. This steel strip temperature calculator 104 predictably calculates the temperatures of the steel strip after cooling at positions where the respective helper rolls 51A are disposed in the first bypass passageway 51 based on the heating rates and the like of the heating zone 20 and soaking zone 30 at the common speed, and feeds the predicted results to a heater selector 105.

The heater selector 105 feeds signals to a temperature indication controller 107 to control an electric current controller 108, so that the current flowing from a power source 109 to heaters 110 can be controlled. These heater 110 may preferably have construction capable of heating the entire area in the axial direction of the helper roll 51A.

The roll temperatures resulted from heating by these heaters 110 are detected by the roll thermometer 51C which feeds the detection signals to a learner 106, and the strip thermometer 51B detects the strip temperatures at places and feeds signals to the learner 106.

Consequently, the general speed in the continuous annealing furnace is calculated by this control means, whereby the temperatures of the steel strip at places in the first bypass passageway 51 are predicted, so that the respective helper rolls 51A can be heated by the heaters 110 to temperatures equal to the predicted temperatures, thereby enabling to keep very small the difference in temperature between the steel strip and the respective helper rolls 51A. Furthermore, the temperatures of the rolls and the steel strip after heating are respectively detected by the thermometers, and the difference of the latter from the predicted temperature of the steel strip is calculated by the learner 106 and fed to the processor 102, with the result that learning controls are effected, whereby the difference between the predicted temperature of the steel strip and the actual temperature of the steel strip becomes small, so that proper current control of the heater can be effected and, when the annealing specification including the dimensions of the steel strip, heat patterns and the like are changed, an annealing operation with high yield can be attained by quickly changing the roll temperatures.

Furthermore, a carry-out portion 53 for carrying the steel strip out of the furnace is provided at the lower portion of the first cooling zone 40, and a second bypass passageway 54 for directly carrying the steel strip out toward the steel sheet carry-out device provided which will be described hereinafter at the outlet of the main body of the continuous annealing furnace from the carryout portion 53.

The steel strip, which has been soaked at a predetermined temperature in the soaking zone 30 and thereafter conveyed through the first bypass passageway 51, or rapidly cooled in the first cooling zone 40, can enter the second cooling zone 60 following the first cooling zone 40. The second cooling zone 60 is provided therein with hearth rolls 61 for supporting the steel strip at the top and at the bottom and conveying same and deflector roll 62 disposed at the outlet thereof for deflecting the steel strip to the third cooling zone 70 that follows.

Figure 8:
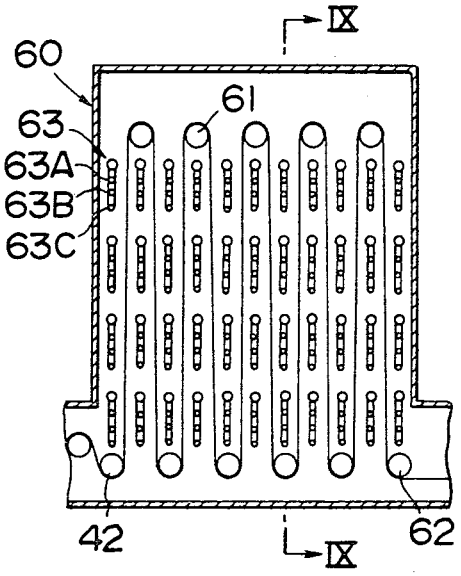
FIG. 8 is a sectional view showing the interior of the second cooling zone.
Figure 9:
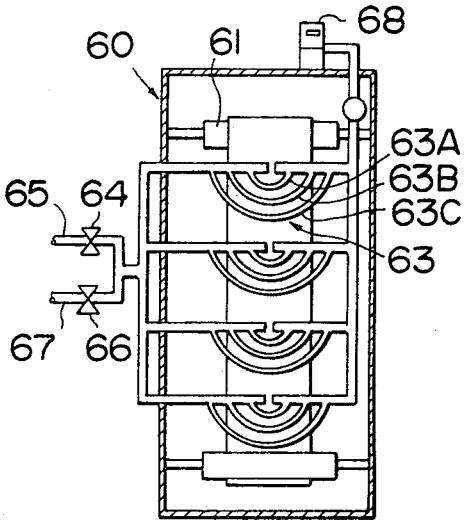
FIG. 9 is a sectional view taken along the line IX—IX in FIG. 8.

Radiators 63 constituting hot-cold change-over means, four of which are arranged in series in the vertical direction as shown in FIGS. 8 and 9, are disposed at opposite sides of the respective conveying passageways, through which the steel strip is conveyed, in the second cooling zone 60. The radiators 63 each comprise a small letter 'U' shaped first tube 63A, a medium letter 'U' shaped second tube 63B and a large letter 'U' shaped third tube 63C, all of which are opposed to the surface of the steel strip being conveyed through the respective conveying passageways. Connected to the inlet side of the radiators 63 are a heating fluid pipe 65 for introducing heating gas through a change-over valve 64 and a cooling fluid pipe 67 for introducing cooling gas through a change-over valve 66. Furthermore, connected to the outlet side of the radiators 63 is an exhaust fan 68 for discharging the heating gas or cooling gas, which has been introduced into the radiators 63. More specifically, the heating gas or cooling gas, which has been introduced into the radiators 63 by the switching operation of the change-over valve 64 or 66, passes through the first, second and third tubes 63A, 63B and 63C, being capable of slowly cooling or handling at a predetermined temperature the steel strip by the radiant heat emitted therefrom. Here, in the radiator 63, the respective tubes 63A, 63B and 63C are each provided therein with a flow rate regulating valve, not shown. When these flow rate regulating valves are operated, the flow rates of heating gas or cooling gas to the respective tubes 63A, 63B and 63C are regulated, whereby the distribution of radiant heats acting on the steel strip in the widthwise direction thereof is controlled, so that the steel strip can be uniformly slowly cooled or held at a predetermined temperature.

The steel strip, which has been slowly cooled or held at a predetermined temperature in the second cooling zone 60, subsequently can enter the third cooling zone 70. In the third cooling zone 70, there are provided hearth rolls 71 for supporting the steel strip from above to below and vice versa and conveying same, and deflector rolls 72 for deflecting and delivering the steel strip to the steel strip carry-out device are provided at the outlet of the third cooling zone.

Figure 10:
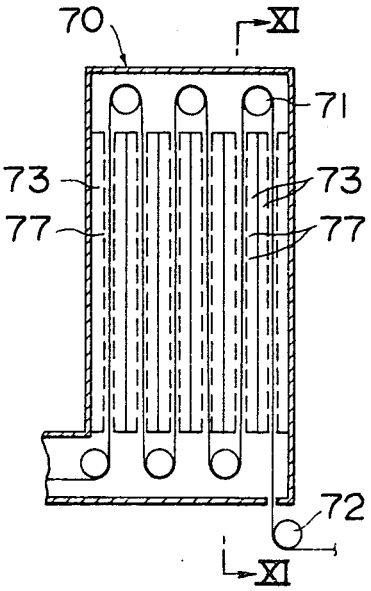
FIG. 10 is a sectional view showing the interior of the third cooling zone.
Figure 11:
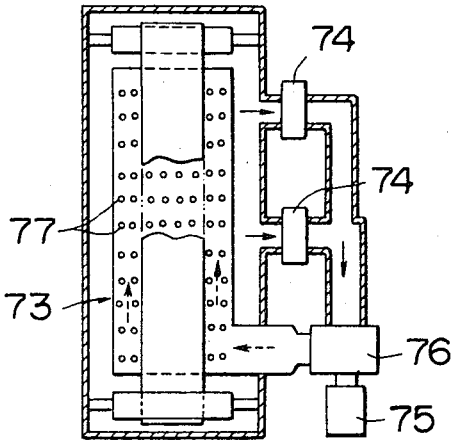
FIG. 11 is a sectional view taken along the line XI—XI in FIG. 10.

Furthermore, as shown in FIGS. 10 and 11, in the third cooling zone 70, plenum chambers 73 are disposed at opposite sides of the respective conveying passageways, through which the steel strip is conveyed. HN gas as the gaseous atmosphere in the furnace is delivered into the inner space of plenum chambers 73 in a condition compressed by a circulating fan 76 driven by an electric motor 75 and in a condition cooled by a water-cooled cooler 74, blown out to the opposite sides of the steel strip from a plurality of blow-out openings penetrated in the surfaces of the plenum chambers 73 opposed to the respective conveying passageways for the steel strip, and can cool the steel ingot substantially to room temperature.

The steel strip, which has been cooled in the third cooling zone or rapidly cooled in the first cooling zone, thereafter passes through the second bypass passageway 54 and sent out, passes through deflector rolls 72, and is delivered into the steel strip carry-out device through a tension meter roll 81 incorporating therein a tension meter so as to constitute tension control means which will hereunder be described and a dancer roll 82, the vertical movement of which is controllable.

The steel strip carry-out device comprises: an outer looper 85 provided in a section where the condition of tension is isolated by bridle rolls 83, 84 and making it possible to shear the steel strip in a shearing machine 86 without stopping the operation of the main body of continuous annealing furnace; a shearing machine 86 for shearing the steel strip, which has been annealed, to a predetermined length; a recoiler 87 for winding up the steel strip, which has been shorn; and sampling means 88 including a sample punch and the like for picking up from the annealed steel strip specimens to be tested in mechanical, electromagnetic and other properties.

Further, the tension control means in the aforesaid continuous annealing apparatus is formed as follows. Namely, respective bridle rolls 16, 41, 42 and 83 are formed into cylinders each having axially uniform diameters so that the contact area between the steel strip and the roll can be made large to minimize the contact surface pressure therebetween, and the frictional coefficient therebetween is made high to increase the difference in tension between portions of the steel strip forwardly and rearwardly of the roll, so that the tension at the portions of the steel strip forwardly and rearwardly of the position where the rolls are provided, can be isolated. Consequently, the interior of the furnace is divided by adjacent bridle rolls 16, 41, 42 and 83, whereby a plurality of tension control blocks are formed which are variable in tension discontinuously from one to another.

Figure 12:
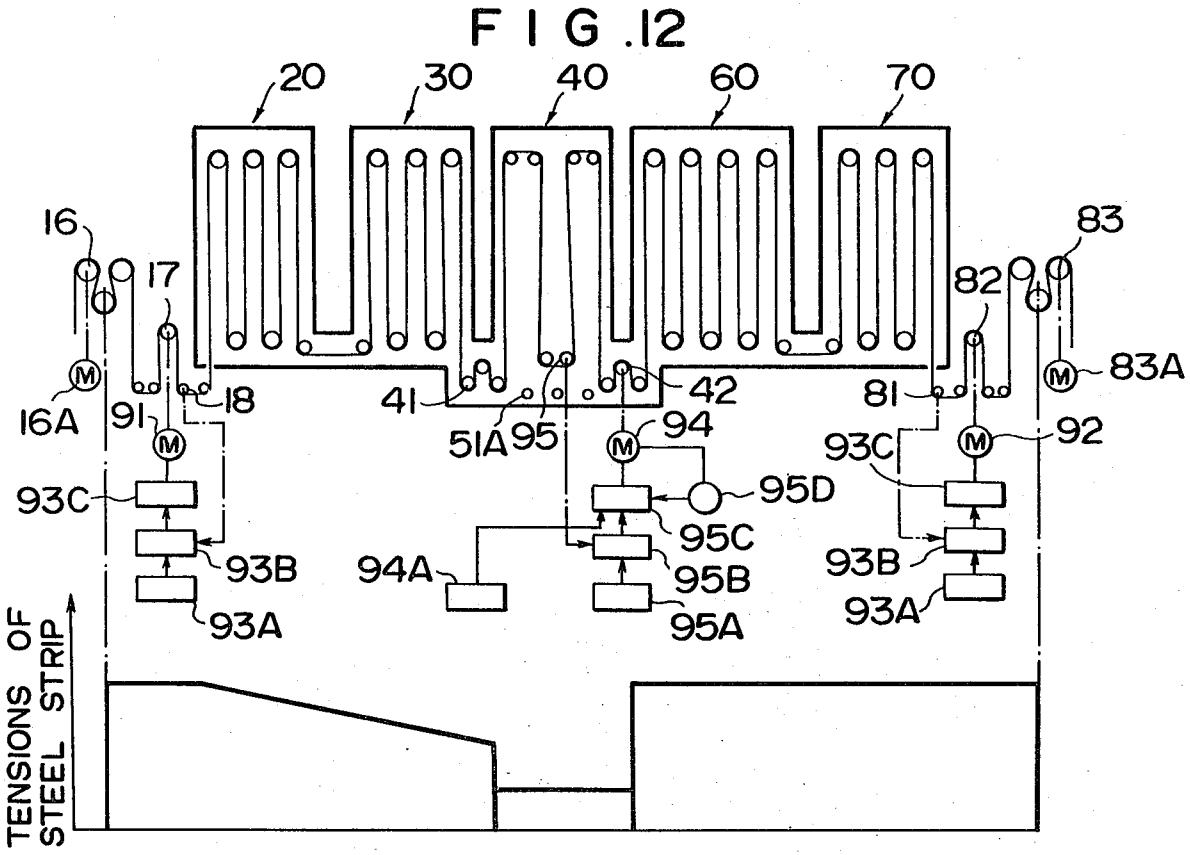
FIG. 12 is an explanatory view showing the steel strip tension control means and the steel strip tensions in the furnace thereby.

More specifically, as shown in FIG. 12, a tension control block defined by the bridle rolls 16 and 41 is set at a required tension condition by the dancer roll 17 controlled by a torque motor 91, and a tension control block defined by the bridle rolls 42 and 83 is set at a required tension condition by the dancer roll 82 controlled by a torque motor 92. Here, the dancer rolls 17, 82, which have been vertically displaced to control the tensions are restored to a vertically central position i.e., the original position, by changing the rotational speed of the driving motors 16A, 83A. The tension required for the respective tension control blocks are transmitted to tension controllers 93B as command signals 93A; and the tension controllers 93B, based on comparison between output values from the tension meter rolls 18, 81 and the command signals 93A, rotate the torque motors 91, 92 in the normal or reverse direction for the number of rotations required through motor torque controllers 93C to vertically move the dancer rolls 17, 82 so that the tensions of the respective tension control blocks can be controlled to the conditions required by the command signals 93A.

Furthermore, either one of the bridle roll 41 or the bridle roll 42 (in this embodiment, the bridle roll 42) is connected thereto with a rotatably driving motor 94 constituting a tension control mechanism and rotating the bridle rolls 41, 42 in such a manner that the steel strip can by conveyed at a predetermined conveying speed based on a steel strip conveying speed command 94A. A tension meter roll 95 incorporating therein a tension meter capable of detecting the actual tension condition in a tension control block is provided in the tension control block defined by the bridle roll 41 and the bridle roll 42. The tension required for the tension control block defined by the bridle roll 41 and the bridle roll 42 is transmitted to a tension controller 95B as a command signal 95A, the tension controller 95B, based on comparison between the command signal 95A and an output value of the tension meter roll 95, controls the number of rotations of the rotatably driving motor 94 through a rotation number controller 95C, whereby the rotation of the bridle roll 42 is varied, so that the tension in this tension control block can be controlled to the required condition. In addition, the number of rotations of the rotatably driving motor 94 is fed back to the rotation number controller 95C through a rotation number detector 95D.

Description will hereunder be given of action in the abovedescribed embodiment. Upon being cold-rolled, the steel strip is wound out by an uncoiler 11, connected to another steel strip in the welder 12, and rolling oil adhered to the surface of the steel strip is removed therefrom by the cleaning equipment 13, and thereafter, delivered into the main body of the annealing furnace through the inlet looper 14 and the like. The steel strip is subjected to annealing treatment in a heat cycle corresponding to the grade of steel thereof, passes through the outlet looper 85, is shorn to a predetermined length by the shearing machine 86, and thereafter, wound up by the recoiler 87.

Figure 13:
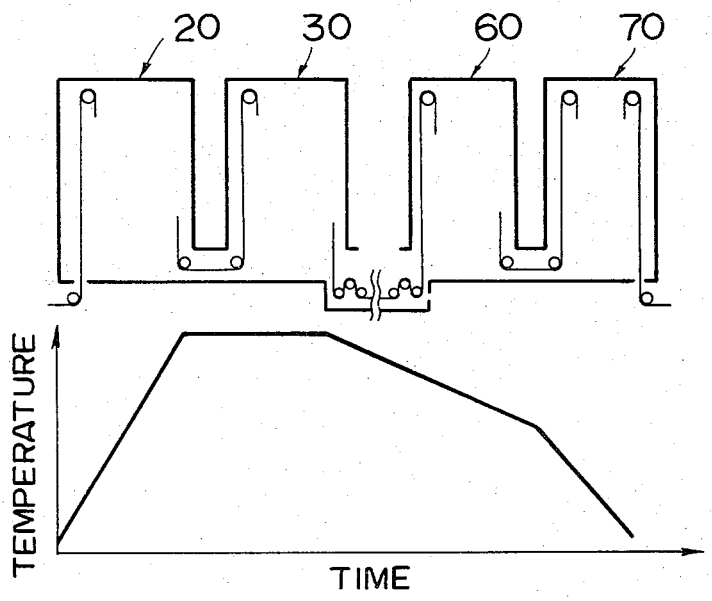
FIG. 13 is a diagram showing the heat cycle for the black tinplate.

Here, in the case the steel strip is one for producing the soft black tinplate, the steel strip is subjected to the annealing treatment in the heat cycle as shown in FIG. 13. More specifically, the steel strip is heated in the heating zone 20, soaked at a temperature of 700° to 800° C. in the soaking zone 30, passes through the first bypass passageway 51, and is directly introduced into the second cooling zone 60 without passing through the interior of the first cooling zone 40. The steel strip, which has been introduced into the second cooling zone 60, receives at the opposite surfaces thereof the radiant heat emitted from the radiators 63 constituting the hot-cold change-over means in the second cooling zone 60 and into which the cooling gas is caused to flow by opening the change-over valve 66, and is slowly cooled at about 450° C. Here, the flow rate regulating valves provided in the respective tubes 63A, 63B and 63C of the radiator 63 are regulated with one another, whereby the radiant heat emitted from the radiator 63 is the widthwise direction is controlled, so that the steel strip can be slowly cooled under a uniform distribution in the widthwise direction thereof. The steel strip, which has been slowly cooled in the second cooling zone 60 as described above, is further introduced into the third cooling zone 70, cooled to substantially room temperature by the cooling gas blown out of the blow-out openings 77 of the plenum chambers 73 provided in the third cooling zone 70, and thereafter, discharged to the outside of the furnace. In addition, in the case this steel strip for producing the black tinplates being at high temperature through the first bypass passageway 51, the heat isolating dampers 52 provided at the respective lower end portions of the plenum chambers 44 in the first cooling zone 40 are closed, so that such adverse effects can be prevented that the radiant heat emitted from the steel strip enters the inner space of the first cooling zone 40 to cause thermal deformation to the plenum chambers 44 and the like.

Furthermore, in this first bypass passageway 51, such a control is effected that the roll temperatures of the respective helper rolls 51A come close to the temperatures of the steel strip at respective positions of rolls predictably calculated. Namely, the difference in temperature between the steel strip and the helper rolls 51A disappears, thereby enabling to obtain annealed black tinplates with high quality having good shape.

Figure 14:
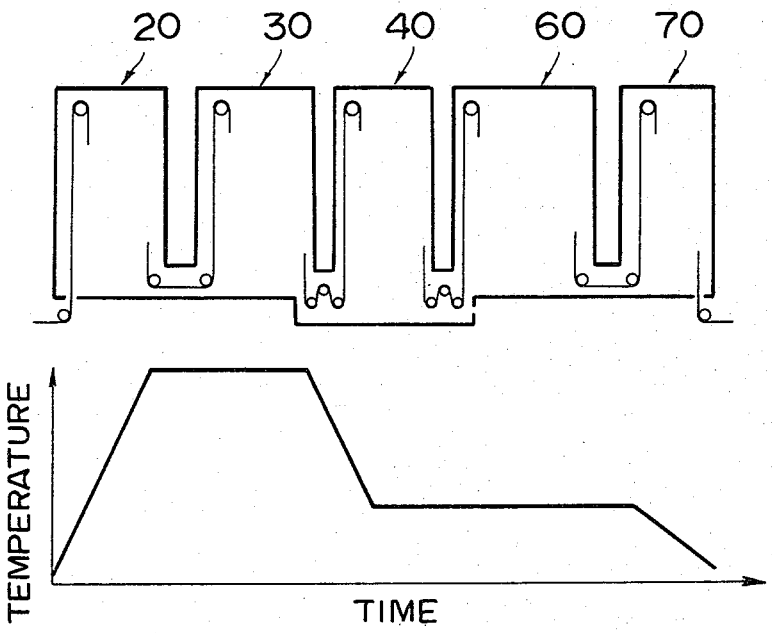
FIG. 14 is a diagram showing the heat cycle for the soft black tinplate or cold-rolled steel sheet for drawing.

In the case the steel strip is one for producing cold-rolled steel sheets for drawing or soft black tinplates, the steel strip is annealed under a heat cycle as shown in FIG. 14. More particularly, the steel strip is elevated in temperature in the heating zone 20, soaked at a temperature of 700° to 800° C. in the soaking zone, and then, introduced into the first cooling zone 40. The steel strips, which have been introduced into the first cooling zone 40, are rapidly cooled to a temperature of about 300° to 500° C. at a cooling rate of approximately 30° to 50° C./sec for example, receiving at the surface thereof the cooled HN gas blown out of the slit-shaped blow-out nozzles 48 of the plenum chambers 44 constituting the forcible cooling means. Here, the flow rates of cooling gas flowing into the compartments divided by the partition walls 49 in the respective plenum chambers 44 are regulated by operating the respective flow rate regulating dampers 50, whereby the distribution of flow rates of the blow-out nozzles 48 in the widthwise direction are controlled, so that the steel strips can be rapidly cooled in the condition where the distribution in temperature in the widthwise direction of the steel strip is made uniform. The steel strips, which have been rapidly cooled in the first cooling zone 40 as described above, receiving the radiant heat of the radiators 63, into which heating gas is caused to flow by opening the change-over valves 64 in the second cooling zone 60, are held in the condition of temperature upon being rapidly cooled for 1 to 5 min to be subjected to the overaging treatment, softened satisfactorily, thereafter, cooled to substantially room temperature by the cooling action of the plenum chambers 73 in the third cooling zone 70, and then, carried out of the furnace.

In addition, in annealing the abovedescribed cold-rolled steel sheets for drawing or soft black tinplates, as shown in FIG. 12, a tension of the steel strip in the tension control block defined by the bridle rolls 16 and 41, i.e., in the heating zone 20 and the soaking zone 30 is set at a required tension condition through a tension controller 93B operated based on a command signal 93A and an output value from the tension meter roll 18, a torque motor 91 controlled by a motor torque controller 93C and the dancer roll 17. Furthermore, a tension of the steel strip in the tension control block defined by the bridle rolls 42 and 83, i.e., in a second cooling zone 60 and a third cooling zone 70 is likewise maintained at a required tension condition by vertically moving a dancer roll 82. Further, a tension of the steel strip in the tension control block defined by the bridle rolls 41 and 42, i.e., in the first cooling zone 40 is set at a required low tension condition by a tension controller 95B operated based on a command signal 95A and an output value from a tension meter roll 95, a rotatably driving motor 94 driven by a rotational number controller 95C and a bridle roll 42. Namely, the tensions in the respective tension control blocks are maintained at required tension conditions independently of one another, and the tension of the steel strip in the first cooling zone 40 is set at a tension condition lower than the tensions in the tension control blocks disposed forwardly and rearwardly of the first cooling zone 40, and hence, despite irregularities in cooling tend to occur in the steel strip at a high cooling rate, irregular shapes of the steel strip, cooling buckling and the like do not occur.

Figure 15:
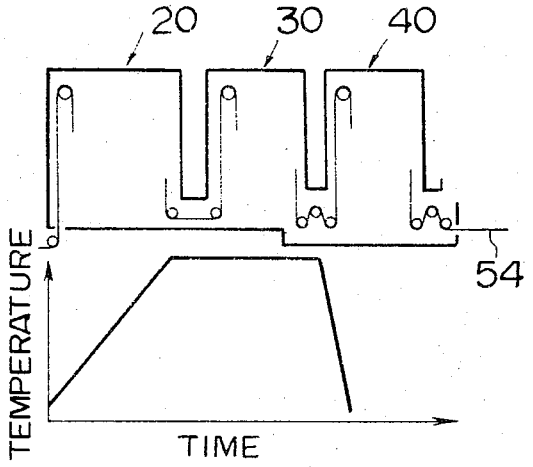
FIG. 15 is a diagram showing the heat cycle for the high tension cold-rolled steel sheet.

Furthermore, in the case the steel strip is one for producing the highstrength cold-rolled steel sheets, the steel strip is annealed under the heat cycle shown in FIG. 15. More specifically, the steel strip is heated in the heating zone 20, soaked to a temperature of 800° to 850° C. to partially generate $\gamma$ phase in the ferrite in the soaking zone 30, and thereafter, introduced into the first cooling zone 40. The steel strip, which has been introduced into the first cooling zone 40, receives at the surfaces thereof the cooling gas of high flow rate blown out of the slit-shaped blow-out nozzles 48 of the plenum chambers 44 constituting the forcible cooling means in the first cooling zone 40, the distribution of blow-out quantities from the blow-out nozzles 48 in the widthwise direction is regulated by operating the flow rate regulating dampers 50 in the plenum chambers 44, so that the steel strip can be rapidly cooled in the condition where the distribution in temperature in the widthwise direction of the steel strip is made uniform. The steel strip, which has been rapidly cooled to a low temperature in the first cooling zone 40, passes through the carry-out portion 53, is introduced into the second bypass passageway 54 and directly introduced to the steel strip carry-out device outside the furnace without passing through the second cooling zone 60 and the third cooling zone 70.

Figure 16:
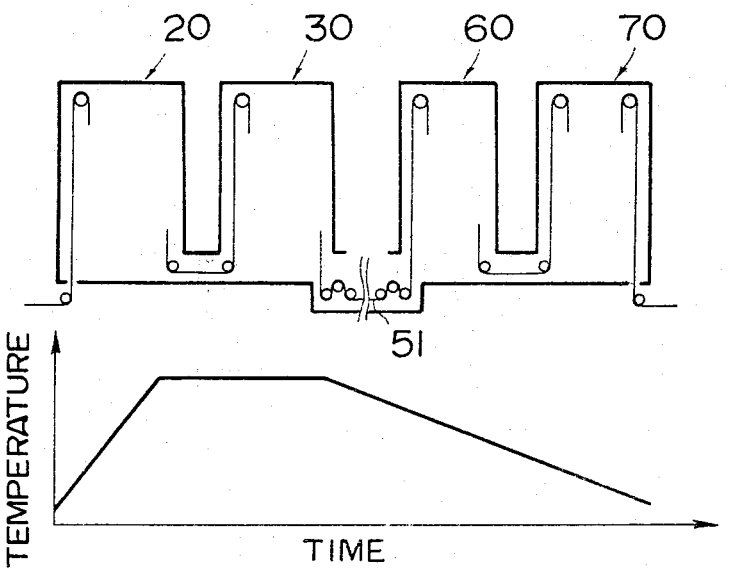
FIG. 16 is a diagram showing the heat cycle for the silicon steel sheet.

Further, in the case steel strip is one for producing the silicon steel sheets, the steel strip is annealed under a heat cycle shown as the heat cycle in FIG. 16. More specifically, the steel strip is heated in the heating zone 20, soaked to a comparatively high temperature of approximately 800° to 1000° C., thereafter, passes through the first bypass passageway 51, i.e., without passing through the first cooling zone 40, is directly introduced into the second cooling zone 60, and further led to the third cooling zone 70. In the second cooling zone 60 and the third cooling zone 70, the steel strip is cooled through the cooling actions by the radiators 63 constituting the hot-cold change-over means and the plenum chambers 73 constituting the forcible cooling means. In addition, in the first bypass passageway 51, similarly to the abovedescribed case of annealing the black tinplates, the roll temperatures of the respective helper rolls 51A are controlled, and the difference in temperature between the steel strip and the helper rolls 51A disappears, thereby enabling to obtain annealed silicon steel sheets with high quality having good shape.

In the abovedescribed embodiment, the steel strips different in the grades of steel such as the black tinplate, soft black tinplate, cold-rolled steel sheet for drawing, high-strength cold-rolled steel sheet, silicon steel sheet can be annealed in a single continuous annealing apparatus. Consequently, even if the quantities of the various grades of steel required to be treated are respectively small, the operating efficiency of this continuous annealing apparatus can be maintained to be high. Furthermore, the tensions of the steel strip in the line of the continuous annealing apparatus can be set independently of one another in a plurality of tension control blocks and the tension of the steel strip in the first cooling zone 40 can be set at a value lower than the tensions of the steel strip in the zones disposed forwardly and rearwardly of the first cooling zone 40, so that irregular shapes of the steel strip or cooling bucking can be prevented from occurring.

Figure 17:
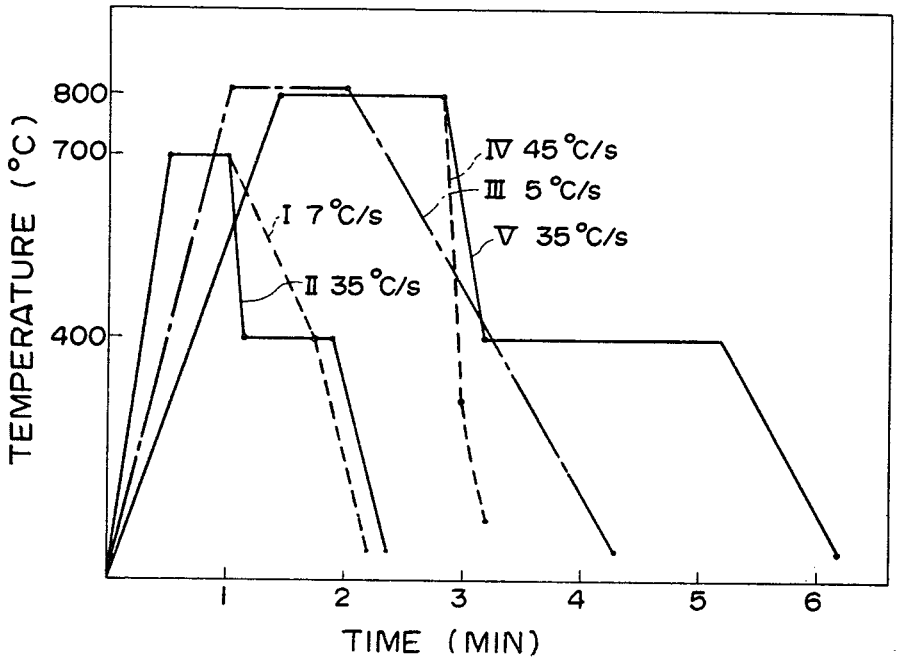
FIG. 17 is a diagram showing the heat cycle for the various types of steel strips experimentally obtained by the present inventor.

In addition, it is recognized that, as the result of that the grades of steel having compositions shown in Table 1 were annealed under the heat cycle shown in FIG. 17 in the abovedescribed embodiment of the continuous annealing apparatus, the steel strips having the mechanical or electromagnetic properties as shown in Table 2 were obtained with said steel strips being in satisfactorily annealed conditions, respectively.

TABLE 1

| Type (JIS Standard) | Chemical Composition (%) C | Si | Mn | P | S | Cr | Al | Dimension (mm) | Heat Cycle |
|---|---|---|---|---|---|---|---|---|---|
| Black tinplate SPB-T4 | 0.09 | — | 0.35 | 0.012 | 0.016 | — | — | 0.24 × 860 | I |
| Black tinplate SPB-T3 | 0.07 | — | 0.31 | 0.011 | 0.011 | — | — | 0.32 × 762 | II |
| Cold-rolled steel sheet for drawing SPCD | 0.01 | 0.02 | 0.32 | 0.12 | 0.015 | — | 0.040 | 0.8 × 1000 | III |
| High-strength cold-rolled steel sheet | 0.05 | — | 1.21 | 0.014 | 0.016 | 0.5 | — | 0.8 × 1000 | IV |
| Silicon steel sheet S50 | 0.01 | 0.35 | 0.30 | 0.019 | 0.018 | — | — | 0.5 × 1000 | V |

TABLE 2

| Type (JIS Standard) | Mechanical Properties: Yield Point Kg/mm² | Tensile strength Kg/mm² | Elongation % | Hardness $H_R30$ T | Electromagnetic Properties: Iron loss W/Kg W10/50 | W15/50 | Flux density Tesla B25 | B50 |
|---|---|---|---|---|---|---|---|---|
| Black tinplate SPB-T4 | | | | 58 | | | | |
| Black tinplate SPB-T3 | | | | 55 | | | | |
| Cold-rolled steel sheet for drawing SPCD | 20 | 32 | 46 | | | | | |
| High-strength cold-rolled steel sheet | 20 | 42 | 40 | | | | | |
| Silicon steel sheet S50 | | | | | 3.8 | 7.8 | 1.68 | 1.77 |

Furthermore, in the abovementioned embodiment, such a case has been described that as one of tension control block in the furnace, the first cooling zone 40 is defined by the bridle rolls 41, 42 which are disposed forwardly and rearwardly of the first cooling zone 40, and the tension in this tension control block is set at a value lower than those in other tension control blocks. However, if bridle rolls are provided at the outlets of the heating zone and soaking zone, respectively, whereby a different distribution of tension control blocks is formed and a tension of the steel strip in a tension control block corresponding to the heating zone is set at a value higher than those in other tension control blocks, then, despite the steel strip is progressively elevated in temperature to be subjected to thermal expansion, the steel strip can avoid loosening and a danger of the movement in a zigzag line. Furthermore, if the tension of the steel strip in the tension control block corresponding to both the outlet of the heating zone and the soaking zone is set at a value lower than that in the tension control block, then, despite the steel strip is softened under high temperature and the yield point thereof is decreased, it becomes possible to prevent the quantities of plastic deformation of the steel strip from increasing.

As has been described hereinabove, according to the first conception of the present invention, the grades of steel different in required heat cycle can be efficiently annealed, according to the second conception of the present invention, the thermal effects of the radiant heat emitted from the steel strip, while the steel strip bypasses the first cooling zone, rendered to the interior of the first cooling zone can be prevented, and, according to the third conception of the present invention, proper tensions are applied to the respective zones in the furnace independently of one another, so that a stable condition can be ensured.

It should be apparent to one skilled in the art that the above-described embodiment are merely illustrative of but a few of the many possible specific embodiments of the present invention. Numerous and varied other arrangements can be readily devised by those skilled in the art without departing from the spirit and scope of the invention.

What is claimed is:

1. A steel strip continuous annealing apparatus comprising:

a heating-soaking zone for heating a steel strip to a predetermined temperature and for soaking the steel strip at said temperature;

a first cooling zone subsequent to said heating-soaking zone for rapidly cooling the steel strip at a predetermined cooling rate;

first forcible cooling means incorporated in said first cooling zone for operation of the rapid cooling;

a second cooling zone subsequent to said first cooling zone for slowly cooling the steel strip or holding the steel strip at a predetermined temperature;

hot-cold change-over means in said second cooling zone for selectively either slowly cooling the steel strip or holding the steel strip at a predetermined temperature;

a third cooling zone subsequent to said second cooling zone for cooling the steel strip to substantially room temperature;

second forcible cooling means incorporated in said third cooling zone for operation of the cooling to substantially room temperature;

a steel strip feeder for feeding the steel strip into said heating-soaking zone;

a steel strip carry-out device for carrying the steel strip out of said third cooling zone;

means for directly bypassing the steel strip from the heating-soaking zone through a first bypass passageway to said second cooling zone; and means for directly bypassing the steel strip from the first cooling zone through a second bypass passageway to said steel strip carry-out device, whereby different grades of steel may be processed.

2. A steel strip continuous annealing apparatus as set forth in claim 1, wherein said forcible cooling means incorporated in the first cooling zone is a cooling gas blow-out device for forcible blowing out a cooling gas from plenum chambers opposed to opposite surfaces of the steel strip.

3. A steel strip continuous annealing apparatus as set forth in claim 1 wherein said hot-cold change-over means incorporated in the second cooling zone comprises at least one radiator provided opposed to opposite surfaces of the steel strip and having a cooling gas or a heated gas selectively, forcibly circulated therethrough.

4. A steel strip continuous annealing apparatus as set forth in claim 1, wherein said forcible cooling means incorporated in the third cooling zone comprises a cooling gas blow-out device for forcibly blowing out a cooling gas from plenum chambers opposed to opposite surfaces of the steel strip.

5. A steel strip continuous annealing apparatus as set forth in claim 1, wherein said steel strip feeder includes an uncoiler, a cleaning equipment and a looper.

6. A steel strip continuous annealing apparatus as set forth in claim 1, wherein said steel strip carry-out device includes a looper, sampling means and a recoiler.

7. A steel strip continuous annealing apparatus as set forth in claim 1, wherein helper rolls for supporting the steel strip and conveying same are provided in said first bypass passageway, and said helper rolls are controlled in temperature in such a manner that the roll temperatures of the respective helper rolls come close to the temperatures of the steel strip predictably calculated based on the furnace operating conditions.

8. A steel strip continuous annealing apparatus comprising:

a heating-soaking zone for heating a steel strip to a predetermined temperature and for soaking the steel strip at said temperature;

a first cooling zone subsequent to said heating-soaking zone for rapidly cooling the steel strip at a predetermined cooling rate;

first forcible cooling means incorporated in said first cooling zone for operation of the rapidly cooling;

a second cooling zone subsequent to said first cooling zone for slowly cooling the steel strip or holding the steel strip at a predetermined temperature;

hot-cold change-over means in said second cooling zone for selectively either slowly cooling the steel strip or holding the steel strip at the predetermined temperature;

third forcible cooling means comprising:

a third cooling zone subsequent to said second cooling zone for cooling the steel strip to substantially room temperature; and second forcible cooling means incorporated in said third cooling zone for operation of the cooling to substantially room temperature;

a steel strip feeder for feeding the steel strip into said heating-soaking zone;

a steel strip carry-out device for carrying the steel strip out of said third cooling zone;

means for directly bypassing the steel strip from the heating-soaking zone through a first bypass passageway to said second cooling zone;

means for directly bypassing the steel strip from the first cooling zone through a second bypass passageway to said steel strip carry-out device; and heat insulating means at the boundary portion between the first cooling zone and the first bypass passageway, for insulating the first bypass passageway from the first cooling zone thermically, whereby different grades of steel may be processed.

9. A steel strip continuous annealing apparatus comprising:

a heating-soaking zone for heating a steel strip to a predetermined temperature and for soaking the steel strip at said temperature;

a first cooling zone subsequent to said heating-soaking zone for rapidly cooling the steel strip at a predetermined cooling rate;

first forcible cooling means incorporated in said first cooling zone for operation of the rapidly cooling;

a second cooling zone subsequent to said first cooling zone for slowly cooling the steel strip or holding the steel strip at a predetermined temperature;

hot-cold change-over means in said second cooling zone for selectively either slowly cooling the steel strip or holding the steel strip at a predetermined temperature;

a third cooling zone subsequent to said second cooling zone for cooling the steel strip to substantially room temperature;

second forcible cooling means incorporated in said third cooling zone for operation of the cooling to substantially room temperature;

a steel strip feeder for feeding the steel strip into said heating-soaking zone;

a steel strip carry-out device for carrying the steel strip out of said third cooling zone;

means for directly bypassing the steel strip from the heating-soaking zone through a first bypass passageway to said second cooling zone;

means for directly bypassing the steel strip from the first cooling zone through a second bypass passageway to said steel strip carry-out device;

heat insulating means at the boundary portion between the first cooling zone and the first bypass passageway, for insulating the first bypass passageway from the first cooling zone thermically; and tension control means for controlling the tension of the steel strip.

* * * * *